US009286823B2

(12) United States Patent
Park et al.

(10) Patent No.: US 9,286,823 B2
(45) Date of Patent: Mar. 15, 2016

(54) METHOD AND APPARATUS FOR REDUCING POWER CONSUMPTION IN ELECTRONIC EQUIPMENT USING SELF-EMITTING TYPE DISPLAY

(75) Inventors: Su-Jin Park, Gyeonggi-do (KR); Hark-Sang Kim, Daegu (KR); Sang-Ryul Park, Gyeongbuk (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 1090 days.

(21) Appl. No.: 12/720,902

(22) Filed: Mar. 10, 2010

(65) Prior Publication Data

US 2010/0231616 A1 Sep. 16, 2010

(30) Foreign Application Priority Data

Mar. 16, 2009 (KR) ..... 10-2009-0022137

(51) Int. Cl.

*G09G 5/10* (2006.01)
*G09G 3/22* (2006.01)
*G09G 3/32* (2006.01)

(52) U.S. Cl.

CPC ..... *G09G 3/22* (2013.01); *G09G 3/3208* (2013.01); *G09G 2320/0271* (2013.01); *G09G 2320/0613* (2013.01); *G09G 2320/0626* (2013.01); *G09G 2320/106* (2013.01); *G09G 2330/021* (2013.01); *G09G 2340/10* (2013.01); *G09G 2340/12* (2013.01)

(58) Field of Classification Search

CPC ..... G09G 3/30; G09G 3/32; G09G 3/3208; G09G 3/3216; G09G 3/3225; G09G 3/3233; G09G 3/3241; G09G 3/325; G09G 3/3258; G09G 3/3266; G09G 3/3275; G09G 3/3283; G09G 3/3291; G09G 2330/021; G09G 2340/10; G09G 2340/12; G09G 5/10; G09G 3/22; G09G 2320/0271; G09G 2320/0613; G09G 2320/0626; G09G 230/106

USPC ..... 345/55–56, 60, 63, 76–77, 204–206, 345/690, 629; 715/790, 794–797

See application file for complete search history.

(56) References Cited

U.S. PATENT DOCUMENTS

| | | | | |
|---|---|---|---|---|
| 7,872,688 | B2 * | 1/2011 | Relan et al. | 348/584 |
| 2003/0016189 | A1 * | 1/2003 | Abe et al. | 345/55 |
| 2006/0087502 | A1 * | 4/2006 | Karidis et al. | 345/211 |
| 2006/0227125 | A1 | 10/2006 | Wong et al. | |
| 2008/0143978 | A1 * | 6/2008 | Damera-Venkata et al. | 353/94 |
| 2009/0002404 | A1 * | 1/2009 | Barnhoefer et al. | 345/690 |
| 2009/0079678 | A1 * | 3/2009 | Ozawa | 345/77 |
| 2009/0262135 | A1 * | 10/2009 | Huston et al. | 345/629 |
| 2010/0201546 | A1 * | 8/2010 | Bonnet et al. | 340/971 |

FOREIGN PATENT DOCUMENTS

| | | | |
|---|---|---|---|
| JP | 2008139390 | A | 6/2008 |
| KR | 10-2006-0048929 | A | 5/2006 |

(Continued)

*Primary Examiner* — Lun-Yi Lao
*Assistant Examiner* — Jarurat Suteerawongsa
(74) *Attorney, Agent, or Firm* — Cha & Reiter, LLC

(57) ABSTRACT

A method for reducing power consumption in an electronic equipment using a self-emitting type display is provided. The method includes distinguishing image data to be output, correcting each distinguished image data into an image brightness, synthesizing the corrected image data into one piece of output image data, and controlling a driving power for displaying the synthesized output image data as an image.

12 Claims, 5 Drawing Sheets

(56) References Cited

FOREIGN PATENT DOCUMENTS

| | | | | |
|---|---|---|---|---|
| KR | 10-0745982 B1 | 7/2007 | ..... | G09G 3/30 |
| KR | 10-2008-0015679 A | 2/2008 | | |
| KR | 10-2008-0111071 A | 12/2008 | | |

* cited by examiner

BLENDED (ALPHA = 0xF)
AND NO COLOR KEY

BLENDED (ALPHA = 0x9)
AND NO COLOR KEY

METHOD AND APPARATUS FOR REDUCING POWER CONSUMPTION IN ELECTRONIC EQUIPMENT USING SELF-EMITTING TYPE DISPLAY

CLAIM OF PRIORITY

This application claims, under 35 U.S.C. §119, priority to and the benefit of the earlier filing date of that patent application entitled "METHOD AND APPARATUS FOR REDUCING POWER CONSUMPTION IN ELECTRONIC EQUIPMENT USING SELF-EMITTING TYPE DISPLAY" filed in the Korean Intellectual Property Office on "Mar. 16, 2009" as Serial No. 10-2009-0022137, the entire contents of which are incorporated by reference herein.

BACKGROUND OF THE INVENTION

1. Field of the Invention

The present invention relates to the field of an image displays. More particularly, to a method and apparatus for reducing power consumption in an electronic equipment using a self-emitting type display.

2. Description of the Related Art

In recent years, display devices having various forms and uses have come into existence along with the rapid development of a computer and the spread of the Internet. These display devices are installed in a variety of electronic equipments ranging from equipments requiring somewhat large-size displays, such as a digital TV, a computer monitor, etc., to portable equipments requiring small and convenient displays, such as a portable phone, a Portable Digital Assistant (PDA), etc. However, particularly, because the portable equipments are supplied with power sources from rechargeable batteries, unlike the large size equipments, there is a very significant concern to increase a period of time of use of the smaller equipments by reducing the power consumption of the display portions of the device.

Conventionally, the display device can be classified into a transmissive display device, such as Liquid Crystal Display (LCD), and a self-emitting type display device, such as Plasma Display Panel (PDP), Organic Light Emitting Diode (OLED), etc.

As a part of the transmissive display device, the LCD receives white backlight from a backlight unit and passes or blocks out the backlight through a liquid crystal layer. The LCD controls a transmission ratio of the backlight by varying an alignment of the liquid crystal layer in response to voltages applied to electrodes provided on both surfaces of the liquid crystal layer. Transmitted light is converted into a color tone by a color filter and the colored light is emitted so as to be viewed by a user. In order to reduce power, the transmissive display device, such as the LCD, uniformly adjusts a brightness of a backlight light source irrespective of image information. This is because the backlight light source has the same power consumption regardless of whether a black color or a white color represents the image information.

As a part of the self-emitting type display device, the OLED (Optic Light Emitting Diode) is described regarding a light emitting principle. The OLED arranges electrodes on both surfaces of an organic thin film, forms excitons by exciting electrons and holes injected through the electrodes, and generates a specific-wavelength light using energy from the excitons. The self-emitting type display device can realize a full color by exhibiting Red, Green, and Blue (RGB) colors depending on the kind of organic matter included in the organic thin film. An intensity of light generated is purely determined by an intensity of a current supplied from a power source. Unlike the transmissive display device, the self-emitting type display device can enhance the efficiency of power consumption only through a reduction of a magnitude of an input signal because of a characteristic of a self-emitting device with no backlight. That is, the transmissive display device consumes constant power regardless of luminance, but the consumption power of self-emitting type display device is proportional to a flowing current. Because controlling brightness by an amount of a current, the self-emitting type display device consumes a lot of current when exhibiting high light. Thus, low power is essential in using the self-emitting type display device as a display of an electronic equipment, such as a portable phone. Further, simply collectively lowering a driving voltage for all signals of an image can deteriorate picture quality as a decrease of even a brightness of a user-unwanted part of the image may be problematic.

SUMMARY OF THE INVENTION

An aspect of the present invention is to provide an apparatus and method for reducing power consumption in an electronic equipment using a self-emitting type display.

In accordance with an exemplary aspect of the present invention, a method for reducing power consumption in an electronic equipment using a self-emitting type display is provided. The method includes distinguishing image data to be output, correcting each image data distinguished depending on a corresponding application, into a preset image brightness, synthesizing the corrected image data of each application into one piece of output image data, and controlling a driving power for displaying the synthesized output image data as an image.

In accordance with another exemplary aspect of the present invention, a method for reducing power consumption in an electronic equipment using a self-emitting type display is provided. The method includes distinguishing image data to be output into a plurality of section image data depending on the significance of visual information to be delivered to a user, correcting the distinguished section image data into a brightness proportional to the significance, synthesizing the corrected section image data into one piece of output image data, and controlling a driving power for displaying the synthesized output image data as an image.

In accordance with still another aspect of the present invention, an apparatus for reducing power consumption in an electronic equipment using a self-emitting type display is provided. The apparatus includes an image controller. The image controller control a driving power for, after distinguishing image data depending on each application, correcting image data corresponding to each application into a preset image brightness, synthesizing the corrected image data of each application into one piece of output image data, and displaying the synthesized output image data as an image.

Other exemplary aspects, advantages and salient features of the invention will become more apparent to those skilled in the art from the following detailed description, which, taken in conjunction with the annexed drawings, discloses certain exemplary embodiments of the invention in detail.

BRIEF DESCRIPTION OF THE DRAWINGS

The above features of certain exemplary embodiments the present invention will become more apparent from the following detailed description taken in conjunction with the accompanying drawings in which.

Throughout the drawings, like reference numerals will be understood to refer to like parts, components and structures.

DETAILED DESCRIPTION

Figure 1A:
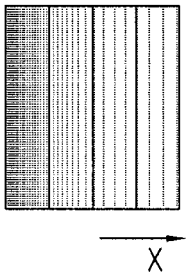
FIG. 1A is a diagram illustrating an image whose luminance increases at regular intervals.

The following description, with reference to the accompanying drawings, is provided to assist a person of ordinary skill in the art with a comprehensive understanding of exemplary embodiments of the invention. The description includes various specific details to assist in that understanding but these details are to be regarded as merely exemplary. Accordingly, those of ordinary skill in the art will recognize that various changes and modifications of the embodiments described herein can be made without departing from the scope and spirit of the invention. Also, descriptions of well-known functions and constructions may be omitted for clarity and conciseness so as not to obscure appreciation of the present invention by a person of ordinary skill with such well-known functions and constructions.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purposes only and not for the purpose of limiting the invention as defined by the appended claims.

It is to be understood that the singular forms "a", "an", and "the" include plural references unless the context clearly dictates otherwise. Thus, for example, reference to "a component surface" typically includes reference to one or more of such surfaces.

By the term "substantially" as used herein means that the recited characteristic, parameter, or value need not be achieved exactly, but that deviations or variations, including for example, tolerances, measurement error, measurement accuracy limitations and other factors known to those skilled in the art, and may occur in amounts that do not preclude the effect the characteristic was intended to provide.

Preferred exemplary embodiments of the present invention will be described below with reference to the accompanying drawings. Exemplary embodiments of the present invention provide a simultaneous interpretation system.

The present invention discloses a technology for an apparatus and method for reducing power consumption in an electronic equipment using a self-emitting type display. The present invention can actively reduce power consumption of the self-emitting type display.

Table 1 below shows a consumption current dependent on each color in a conventional self-emitting type display device.

TABLE 1

| Class | White | Red | Green | Blue | Yellow | Black |
|---|---|---|---|---|---|---|
| IBAT(mA) | 278.8 | 71.1 | 85.5 | 131.3 | 148.6 | 2.4 |
| IDDI(mA) | 5.1 | 5.5 | 5.7 | 5.7 | 5.5 | 5.1 |

Table 1 shows an average value of data obtained by measuring a consumption current at three times when the self-emitting type display device has a luminance of 250 cd (candela). The 'IBAT' represents a current value consumed by an organic compound of the self-emitting type display device, and the 'IDDI' represents a current value consumed in a driver Integrated Circuit (IC) of the self-emitting type display device. From Table 1, it can be appreciated that the 'IDDI' exhibits no great variation in emitting the same luminance, but the 'IBAT' does exhibit a very great variation. That is, 'White' consumes the maximum current of about 278.8 mA, while 'Black' consumes a current of about 2.4 mA. Thus, the current varies by about 116 times as the color changes from black to white.

The above difference of consumption current is caused not by only a difference of color but also a difference of luminosity. Table 2 below shows a consumption current depending on each luminosity in the conventional self-emitting type display device.

TABLE 2

| Class | L252(White) | L224 | L192 | L164 | L132 | L104 | L72 | L48(Black) |
|---|---|---|---|---|---|---|---|---|
| IBAT(mA) | 271.1 | 209.4 | 146.6 | 99.1 | 63.2 | 41.2 | 22.7 | 12.9 |
| IDDI(mA) | 5.9 | 5.9 | 6.0 | 6.0 | 6.0 | 6.0 | 6.0 | 6.0 |

Table 2 shows an average value of data obtained by measuring, at three times, a current consumed depending on luminosity that varies from 'White' to 'Black' in the self-emitting type display device. The 'IBAT' and 'IDDI' are the same as those of Table 1 above. From Table 2, it can be identified that a difference of luminosity between 'L252' and 'L192' is visually small, but consumption current is reduced to 54%.

Accordingly, the self-emitting type display device can reduce consumption power by controlling a color and luminosity (i.e., luminance) of a corresponding image.

A characteristic of a human visual system is described below with reference to FIGS. 1A to 3. FIGS. 1A to 3 are diagrams illustrating the Mach band effect. The Mach band effect is a phenomenon in which visual reaction is made emphasizing a boundary portion when brightness suddenly changes.

Figure 1B:
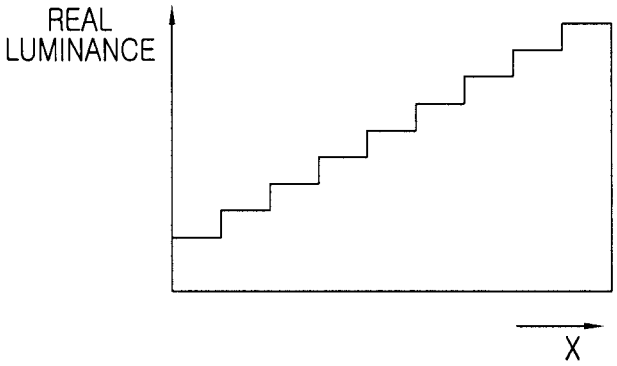
FIG. 1B is a graph illustrating a real luminance of the image of FIG. 1A.

FIG. 1A is a diagram illustrating an image whose luminance increases at regular intervals, and FIG. 1B is a graph illustrating a real luminance of the image of FIG. 1A. In addition, FIG. 1C is a graph illustrating a result of recognizing the image of FIG. 1A in a human visual system.

Figure 1C:
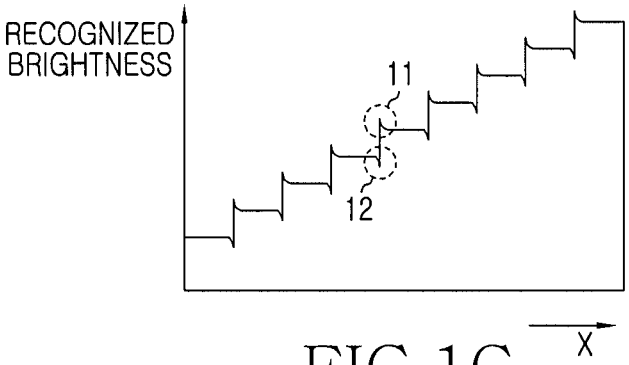
FIG. 1C is a graph illustrating a result of recognizing the image of FIG. 1A in a human visual system.

Referring now to FIGS. 1A, 1B and 1C, assuming that there is an image constituted of bars whose luminance increase at regular intervals along X axis as shown in FIG. 1A, a real luminance forms a step type graph as in FIG. 1B. However, brightness for the human visual system to recognize the image of FIG. 1A appears in a form a little distorted as shown in FIG. 1C. That is, it can be appreciated that a dark portion 12 is recognized darker and a bright portion 11 is recognized brighter at a boundary between bars. Because the boundary is a high frequency region in view of frequency, although luminance (i.e., signal level) of the high frequency region somewhat decreases, it does not greatly have influence on the human visual system.

Figure 2:
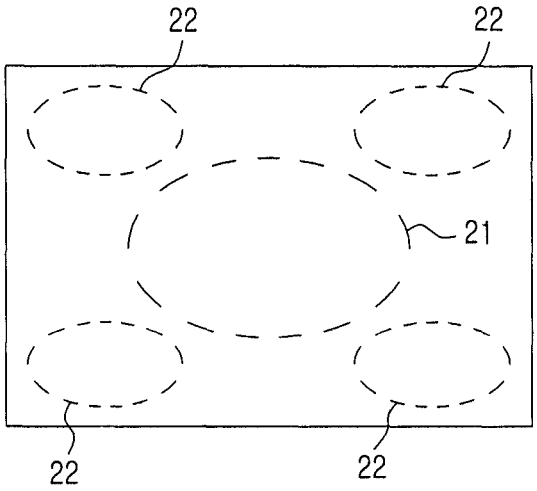
FIG. 2 is a diagram illustrating that a human visual system has a different sensitivity by position on an image.

FIG. 2 is a diagram illustrating that a human psychological visual system has a different sensitivity by position on an image.

Referring now to FIG. 2, because the human psychological visual system has more concern in a center portion 21 of the image, the human psychological visual system is more insensible to variation as the image proceeds to an outer portion 22. Accordingly, although there is a little decrease of a signal level in the outer portion 22 of the image, it does not greatly have influence on a subjective picture quality.

Figure 3:
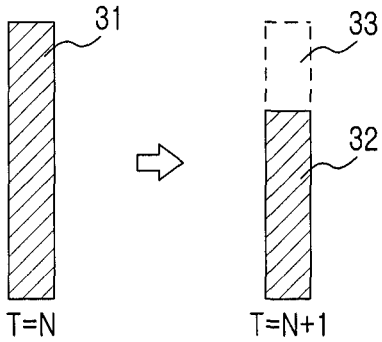
FIG. 3 is a diagram illustrating a characteristic of human recognition of an image quickly varying in a moving picture.

FIG. 3 is a diagram illustrating a characteristic of human recognition of an image quickly varying in a moving picture.

Referring now to FIG. 3, assuming that an image 31 of a time (T=N) shifts down and becomes an image 32 at a next time (T=N+1), a human eyesight recognizes a varied region 33 as a signal mixed during the two times (T=N) and (T=N+1). For example, when the image 31 is black and the background is white, the varied region 33 resulting from a motion of the image 31 is recognized as grey that is a mixture of black and white. Accordingly, although there is little decrease of a signal level in a region or pixel of large motion, the region or pixel may not be greatly sensed by the human visual system.

Figure 4:
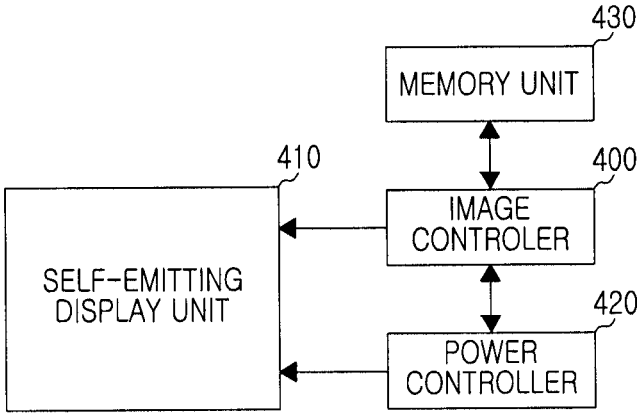
FIG. 4 is a block diagram illustrating a construction of a self-emitting type display device according to an exemplary embodiment of the present invention.

FIG. 4 is a block diagram illustrating a construction of a self-emitting type display device according to an exemplary embodiment of the present invention.

Referring now to FIG. 4, the self-emitting type display device may include an image controller 400, a self-emitting type display unit 410, a power controller 420, and a memory unit 430. The image controller 400 performs a general control of constituent elements. The self-emitting type display unit 410 displays data received from the image controller 400 as an image. The power controller 420 controls a driving power of the self-emitting type display unit 410. The memory unit 430 stores various kinds of information.

The self-emitting type display unit 410 displays image data received from the image controller 400, as an image. As described in the OLED previously, the self-emitting type display unit 410 can realize a full color by exhibiting Red, Green, and Blue (RGB) colors depending on the kind of organic matter included in an organic thin film. At this time, an intensity of generated light is determined only by an intensity of a current supplied from the power controller 420, and the efficiency of consumption power can increase only through a reduction of a magnitude of an input signal because of a characteristic of a self-emitting device. In other words, the self-emitting type display device can reduce power consumption by decreasing an intensity (i.e., luminance) of light of an image.

The image controller 400 controls the display of information as an image output to the self-emitting type display unit 410, at a desired time/position. Particularly, according to the present invention, the image controller 400 can correct data on an image to be output by the self-emitting type display unit 410 and reduce power consumed in the self-emitting type display unit 410. At this time, the power controller 420 supplies necessary power to the self-emitting type display unit 410 under control of the image controller 400.

The memory unit 430 stores a variety of kinds of data, etc. including correction data for image data generated in the image controller 400, and provides the data to the image controller 400.

A method for generating image data in the image controller 400 may be a window blending technique of combining a plurality of layers into one layer and generating an image readily viewed by a user. That is, the window blending technique basically uses three colors (RGB) to display information on a screen, and defines a blending element called an alpha reference value per pixel. The window blending converts this blending element into a percentage (%), thus changing colors. In the window blending technique, when there are two pieces of image data, the two pieces of image data are blended on the basis of the alpha reference value, thus generating new image data. The newly generated image data is blended on the basis of an alpha reference value of other image data, thus generating the other image data. At this time, the image data each are sequentially blended and are generated as one piece of image data. For example, when layer 0 is for a TV image, layer 1 for a window showing an image of a different channel at a side of a screen, layer 2 for a menu, layer 3 for a subtitle, and layer 4 for channel information, the five layers are blended and are displayed as one image in an equipment such as a TV, etc.

Particularly, the image controller 400 can control brightness through a process of adding one layer to control a luminosity value in a layer (or image data) blending process and changing a position of the added layer. Further, the image controller 400 can distinguish image data depending on an application, decrease a brightness of a corresponding application image, and supply a reduced power corresponding to the decrease in the power controller 420.

The application (i.e., an application program) is a program designed to perform a specific function directly to a user or, in some cases, other application program. For example, the application program may include a word processor, a database program, a web browser, a developing tool, a paint brush, an image edition program, a communication program, etc. The application program uses an operating system of a corresponding equipment and services of other support programs. The application program can officially request a work from or provide work to other programs and perform a mutual communication with other programs.

Figure 6A:
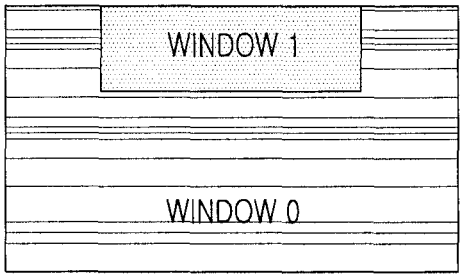
FIGS. 6A and 6B are diagrams illustrating results of synthesizing two pieces of image data depending on an alpha reference value according to an exemplary embodiment of the present invention.
Figure 6B:
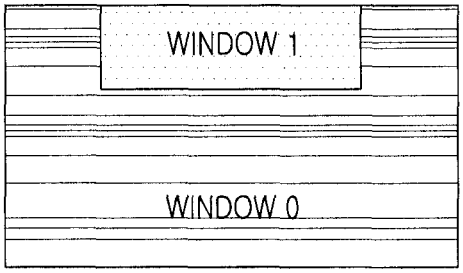

According to an exemplary embodiment of the present invention, upon execution of an application providing a still image such as Web surfing, mailing, document making, etc., the image controller 400 generates a light gray layer of RGB having the highest priority and then, performs blending on the basis of a preset alpha reference value. Here, high priority represents that an order in which a corresponding layer is synthesized with other images is the last. This can make a change of color be identical for the whole image, thus providing an effect that RGB values of all regions are lowered, i.e., an effect that colors of all regions are darkened. Accordingly, because a corresponding still image represents an image whose color changes into a light gray tone, the still image can reduce power consumption of the self-emitting type display device. FIGS. 6A and 6B are diagrams illustrating results of synthesizing two pieces of image data depending on an alpha reference value according to an exemplary embodiment of the present invention. In FIG. 6A, assuming that a light gray layer is synthesized later than a background portion (window1) and blending is performed with an alpha reference value being set to a hexadecimal '0x9', a color of the background portion (window1) can change into a light gray tone. The alpha reference value can be set to various values.

Also, upon execution of an application providing a moving picture such as a video call, etc., the image controller 400 generates a light gray layer of RGB, sets a background portion of a moving picture less than a priority of the generated light gray layer, performs blending on the basis of a preset alpha reference value, and darkens the whole background color. After that, the image controller 400 performs blending by the preset alpha reference value of the moving picture in a process of combining the wholly darkened background with a moving picture portion of the image, and eliminates a distortion of color information of the moving picture. In FIGS. 6A and 6B, an original image is distinguished into a moving picture portion (window0) and a background portion (window1). Also, if a light gray layer is synthesized later than the background portion (window1) and blending is performed with an alpha reference value being set to '0x9' as in FIG. 6B, a color of the background portion (window1) changes into a light gray tone. If blending is performed with an alpha reference value being set to a hexadecimal '0xf' in a process of combining a background portion (window1) with a moving picture portion (window0) as in FIG. 6A, the moving picture portion (window0) can be synthesized without a distortion of color information. At this time, the light gray layer has higher priority than the background portion (window1) and has lower priority than the moving picture portion (window0). Also, because the moving picture portion (window0) is synthesized after the light gray layer, color information on the moving picture portion (window0) may not be distorted. The alpha reference value can be set to various values.

Figure 5:
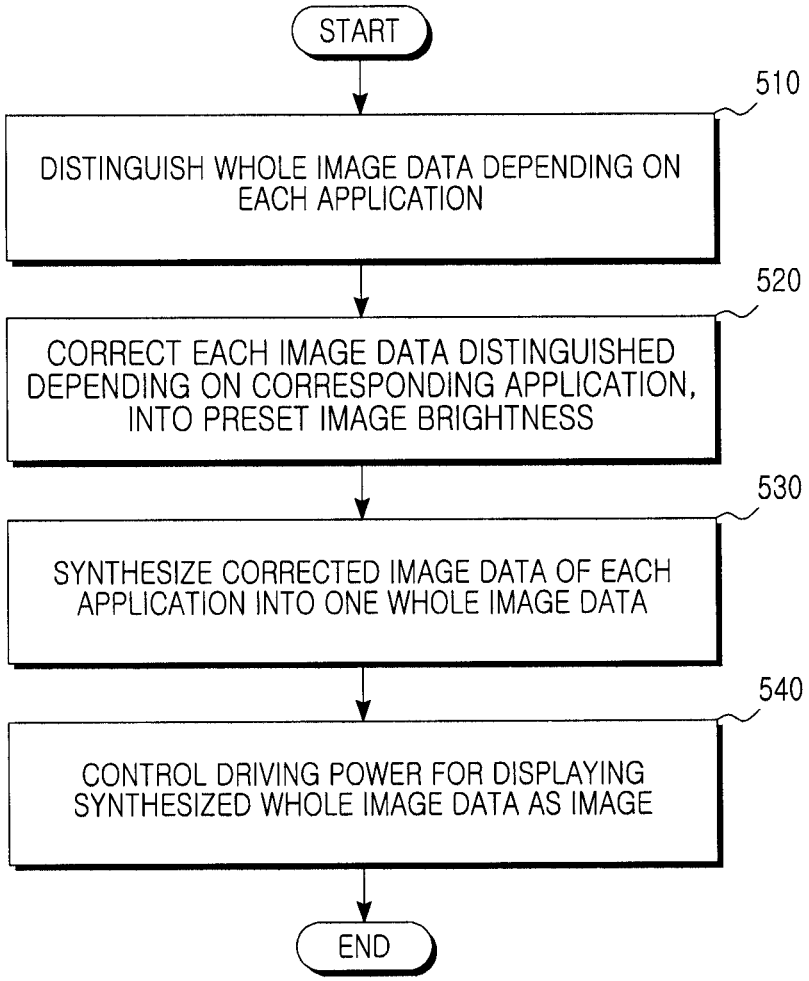
FIG. 5 is a flow diagram illustrating a procedure for reducing power consumption in a self-emitting type display device according to an exemplary embodiment of the present invention.

FIG. 5 is a flow diagram illustrating a procedure for reducing power consumption in a self-emitting type display device according to an exemplary embodiment of the present invention.

Referring now to FIG. 5, in step 510, the image controller 400 distinguishes the whole image data to be displayed on the self-emitting type display unit 410, depending on each application.

In step 520, the image controller 400 corrects each of the image data distinguished, depending on the corresponding application, into a preset image brightness. As above, the correction method can decrease brightness by generating a light gray layer and then blending image data of a corresponding application on the basis of a preset alpha reference value. At this time, the application can be different in significance depending on a reference value such as a frequency of a user's use, a display position on a screen, a driving time, etc., and an intensity of corrected brightness can be also proportional to the significance. Further, image data of a specific application can be distinguished into a plurality of section image data depending on the significance of visual information provided to a user. The intensity of the corrected brightness can be also proportional to the significance of the section image data.

Then, in step 530, the image controller 400 integrates each image data that is distinguished depending on each application and then is corrected in brightness in step 520, and synthesizes the integrated image data into one piece of the whole changed image data. At this time, upon synthesis between corrected image data of each application, image filtering can be performed to filter out a distortion such as a noise, etc. A method for synthesis into the whole changed image data can use a synthesizing technique such as synthesis, blending, interpolation, etc. Also, an image filtering method can be a histogram equalization for uniformly distributing the number of pixels dependent on brightness in image data, an average filter of obtaining an average of predetermined nearby pixel values in each pixel of image data and substituting the average with a current pixel value, etc.

In conclusion, an apparatus and method for reducing power consumption in an electronic equipment using a self-emitting type display according to the present invention can distinguish image data by application and correct brightness, thus reducing power consumption without deteriorating user's readability.

The above-described methods according to the present invention can be realized in hardware or as software or computer code that can be stored in a recording medium such as a CD ROM, an RAM, a floppy disk, a hard disk, or a magneto-optical disk or downloaded over a network, so that the methods described herein can be rendered in such software using a general purpose computer, or a special processor or in programmable or dedicated hardware, such as an ASIC or FPGA. As would be understood in the art, the computer, the processor or the programmable hardware include memory components, e.g., RAM, ROM, Flash, etc. that may store or receive software or computer code that when accessed and executed by the computer, processor or hardware implement the processing methods described herein. As would be recognized, when a general computer system is loaded with software or instructions to execute the processing shown herein, the general processor is converted into a special processor executing at least the processing shown herein.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A method for reducing power consumption in an electronic device including a self-emitting type display, the method comprising:

responsive to an application being initiated, obtaining image data comprising a plurality of image layers for the application;

adding a gray layer to the plurality of image layers;

determining merging sequence of the gray layer and the plurality of image layers based on the application;

merging the gray layer and the plurality of image layers according to the determined merging sequence to generate a screen of the application; and supplying a necessary driving power for the self-emitting type display to display the screen of the application, wherein the gray is arranged between any two image layers among the plurality of image layers based on the application, and is not arranged above a top image layer and below a bottom image layer of the plurality of image layers.

2. The method of claim 1, wherein the plurality of image layers includes:

a first image layer corresponding to a background portion of a video frame and a second image layer corresponding to a foreground portion of the video frame;

wherein, after the first image layer and the gray layer is merged, the second image is merged therewith.

3. The method of claim 1, further comprising filtering for removing a distortion in the screen of the application before displaying the screen of the application.

4. The method of claim 3, wherein the filtering uses at least one of: a histogram equalization and an average filtering.

5. The method of claim 1, wherein the merging is performed based on an alpha reference value preset by the application.

6. The method of claim 1, wherein the gray layer is merged last.

7. An electronic device comprising: a self-emitting type display; and a controller configured to:

responsive to an application being initiated, obtain image data comprising a plurality of image layers for the application;

add a gray layer to the plurality of image layers;

determine a merging sequence of the gray layer and the plurality of image layers based on the application;

merge the gray layer and the plurality of image layers according to the merging sequence to generate a screen of the application; and supply a necessary driving power to the self-emitting type display to display the screen of the application, wherein the gray layer is arranged between any two image layers among the plurality of image layers based on the application, and is not arranged above a top image layer and below a bottom image layer of the plurality of image layers.

8. The device of claim 7, wherein the plurality of image layers includes:

a first image layer corresponding a background portion of a video frame and a second image layer corresponding to a foreground portion of the video frame;

wherein, after the first image layer and the gray layer are merged, the second image is merged therewith.

9. The device of claim 7, wherein, the controller is further configured to filter the screen of the application to remove distortion before displaying the screen of the application.

10. The device of claim 9, wherein the filtering uses at least one of: a histogram equalization and an average filtering.

11. The device of claim 7, wherein the merging is performed based on an alpha reference value preset by the application.

12. The device of claim 7, wherein the gray layer is merged last.

* * * * *